US005983999A

United States Patent [19]

Ito et al.

[11] Patent Number: 5,983,999

[45] Date of Patent: Nov. 16, 1999

[54] LAMINATED HEAT EXCHANGER HAVING REFRIGERANT TUBES AND HEADS

[75] Inventors: Akihiro Ito; Masateru Hayashi; Kazuhiro Tomimasu; Souichiro Umazume; Hideo Kanno; Kouji Fujita, all of Aichi-ken, Japan

[73] Assignee: Mitsubishi Heavy Industries, Ltd, Tokyo, Japan

[21] Appl. No.: 08/925,286

[22] Filed: Sep. 8, 1997

[30] Foreign Application Priority Data

Sep. 9, 1996 [JP] Japan ..... 8-237709

[51] Int. Cl.[6] ..... F28F 9/22

[52] U.S. Cl. ..... 165/153; 165/174; 165/135

[58] Field of Search ..... 165/153, 174, 165/135

[56] References Cited

U.S. PATENT DOCUMENTS 4,903,763 2/1990 Laveran et al. ..... 165/175

FOREIGN PATENT DOCUMENTS

0709640A2 5/1996 European Pat. Off. ..... F28D 1/03

4422178A1 1/1995 Germany ..... F25B 39/02

2250336A 6/1992 United Kingdom ..... F28F 9/22

2276711A 10/1994 United Kingdom ..... F25B 39/02

WO9502159A 1/1995 WIPO .

*Primary Examiner*—Allen Flanigan

*Attorney, Agent, or Firm*—John P. White; Cooper & Dunham LLP

[57] ABSTRACT

A laminated heat exchanger including an inlet header having refrigerant passages therein through which a refrigerant to be cooled is fed, an outlet header having refrigerant passages therein through which the cooled refrigerant is discharged, a radiating laminated structure located between the inlet header and the outlet header, the radiating laminated structure being formed by alternately arranging a plurality of refrigerant tubes and fins in layers, each of the refrigerant tubes having a tank section for storing a refrigerant and a passage section in which the refrigerant stored in the tank section is circulated, and a distributing member located in at least one of the refrigerant passages of the inlet header and the outlet header and used to regulate a flow of the refrigerant in the tank section.

7 Claims, 7 Drawing Sheets

$f = KU/l$ f: FREQUENCY

K: VORTEX MODE NUMBER

U: FLOW RATE

LAMINATED HEAT EXCHANGER HAVING REFRIGERANT TUBES AND HEADS

BACKGROUND OF THE INVENTION

The present invention relates to a laminated heat exchanger adapted for use as an evaporator of a vehicular air conditioner.

FIG. 1 shows a conventional laminated heat exchanger used as an evaporator of a vehicular air conditioner. Referring to FIG. 1, air passages are defined in refrigerant tubes 1 through which a refrigerant flows, and air-side corrugated fines 2 are arranged in these air passages. The refrigerant tubes 1 and the corrugated fins 2 are arranged in layers, their respective top portions are connected to one another, and they all are integrally brazed together. In FIG. 1, numeral 3 denotes a flow of the refrigerant in the laminated heat exchanger, while numeral 4 designates an air current flowing through the air passages.

FIG. 2 is an exploded perspective view of one of the refrigerant tubes 1. A pair of molded plates 5*a* and 5*b* each have a shallow tray portion and deeper refrigerant tank sections 6 formed at one end thereof. The molded plates 5*a* and 5*b* are opposed and bonded to each other, thereby defining between them a U-shaped refrigerant passage 7 through which the refrigerant introduced through one of the tank sections 6 is delivered to the other tank section. Corrugated inner fins 8 are inserted in the passage 7. The inner fins 8 serve to enlarge the refrigerant-side heat transfer area, thereby improving the heat transfer performance.

FIG. 3 is a top plan view of the laminated heat exchanger, FIGS. 4 and 5 are sectional views taken along lines IV—IV and V—V, respectively, of FIG. 3. A refrigerant inlet header 9 is provided on the upper portion of one side face of the heat exchanger through which the refrigerant flows into the heat exchanger. A connecting hole 12 is bored through a side face portion of the header 9. The hole 12 is connected to an inlet port 10 in an endplate 11 by being fitted thereon. The port 10, which is bored through the endplate 11, is an inlet for the refrigerant that opens into the refrigerant tank sections 6. An inlet portion of the refrigerant inlet header 9 has a cylindrical shape adapted for connection with the refrigerant passage 7, while the other end portion has a hollow configuration closed by a plug 13, as shown in FIG. 5. The endplate 11 is not formed with any port that opens into the one refrigerant tank section 6 of each refrigerant tube 1, and the other refrigerant tank section 6 is closed by the endplate 11.

Like the refrigerant inlet header 9, a refrigerant outlet header 14 is provided on the upper portion of the other side face of the heat exchanger. A connecting hole is bored through a side portion of the header 14. This hole is connected to a refrigerant outlet port in an endplate 15 by being fitted thereon. The outlet port is bored through the endplate 15 and opens into the refrigerant tank sections 6. An inlet portion of the refrigerant outlet header 14 has a cylindrical shape adapted for connection with the refrigerant passage 7, while the other end portion has a hollow configuration closed by a plug.

FIG. 6 is a view showing another example of the laminated heat exchanger, in which refrigerant tank sections are arranged on either side of a radiating laminated structure as a core section. Refrigerant tank sections 16, refrigerant inlet header 17, and refrigerant outlet header 18 of this heat exchanger are arranged in the same relation as those of the laminated heat exchanger shown in FIGS. 1 to 5. The laminated heat exchanger of this type may include a dimpled refrigerant passage 7 (not shown in FIG. 6) that are provided with no inner fins 8.

In this arrangement, the refrigerant is introduced through the refrigerant inlet header 9, flows into the refrigerant passage 7 through the inlet port 10, and exchanges heat with air in the passage 7. Then, the refrigerant is discharged through the refrigerant outlet header 14.

However, each conventional laminated heat exchanger described above, especially when used as an evaporator, is subject to the following problem. Immediately after the air conditioner, having the evaporator therein, is activated during its intermittent operation in which it is repeatedly activated and stopped in response to commands from a room-temperature control thermostat, the refrigerant flows in a large quantity through the refrigerant passage in the heat exchanger, though only for a short period of time. At this time, the refrigerant is introduced from the refrigerant inlet header 9 into the refrigerant tank sections 6 through the inlet port 10 of the endplate 11. As the refrigerant flows into each refrigerant tube 1, it suddenly changes its course 90°. As the refrigerant flows into the tank sections 6 via the inlet port 10 in this manner, its flow direction is violently disturbed to cause a strong vortex. Under conditions combining a specific temperature, pressure, refrigerant flow rate, etc., pure tones may be produced in some cases.

FIG. 7 shows flows of the refrigerant in the refrigerant inlet header 9. As shown in FIG. 7, a large vortex causes a substantial turbulence in the region where the refrigerant runs against the plug 13, and the main current of the refrigerant flowing into the refrigerant tank sections 6 is biased to the area under the inlet port 10. Immediately after reactivation, moreover, the flow rate of the refrigerant increases to an extreme in some regions. In some cases, therefore, pure tones may be produced in the same manner as aforesaid.

The following is a description of pure tones produced by a heat exchanger. As compared with a pure tone, a sound (hereinafter referred to as "random sound") that has a certain frequency band covers a plurality of frequencies. If its level is high, therefore, a random sound is hardly distinguishable from background noises (vehicle noises, etc.), so that there is not a good possibility of its arousing a noise problem.

Undoubtedly, on the other hand, a pure tone has its peak at a specific frequency, so that it can be discriminated more frequently by the human ear than a random sound that has equal acoustic energy. This phenomenon depends on human auditory response, so that production of pure tones must be prevented in consideration of the quality of sound or tone, as well as the sound level.

The following is a description of the reason why pure tones are produced. If there is a stepped portion in a flow path, vortexes are produced on the rear-flow side of a flow, as shown in FIG. 8. These vortexes are not stable because they are in contact with no stepped portion. In consequence, a produced sound is not a tone that has a specific frequency, but a sound that has a certain range of frequency.

If a flow path has a groove, on the other hand, there is a stepped portion that can be touched by a vortex, as shown in FIG. 9, so that the vortex is stable. Thus, a produced sound is a pure tone that has a specific frequency.

Based on this principle of sound production, sounds are produced starting at a large number of groove-shaped gaps in the laminated heat exchanger shown in FIG. 4 that are structurally inevitable and are found by observing the structure of the evaporator and its gate pipe junctions.

BRIEF SUMMARY OF THE INVENTION

The object of the present invention is to provide a laminated heat exchanger capable of restraining production of pure tones.

The above object is achieved by a laminated heat exchanger arranged as follows. In the heat exchanger according the present invention, production of pure tones is restrained by reducing vortexes that are created as a refrigerant flows into refrigerant tank sections through a refrigerant inlet header and is distributed into refrigerant tubes and/or by making the resulting distribution uniform to restrain local high-speed currents.

The laminated heat exchanger according to the invention comprises: a radiating laminated structure formed by alternately arranging a plurality of refrigerant tubes and fins in layers, each of the refrigerant tubes having a tank section for storing a refrigerant and a passage section in which the refrigerant stored in the tank section is circulated; an inlet header having refrigerant passages therein, connected to the tank section on one side of the radiating laminated structure, and serving to feed the refrigerant to be cooled to the tank section; an outlet header having refrigerant passages therein, connected to the tank section on the other side of the radiating laminated structure, and serving to discharge the cooled refrigerant from the tank section; and a distributing member located in at least one of the refrigerant passages of the inlet header and the outlet header and used to regulate a flow of the refrigerant in the tank section.

In the case where the laminated heat exchanger is used as an evaporator, for example, the refrigerant that flows in a large quantity into the inlet header immediately after an air conditioner is activated during its intermittent operation in which it is repeatedly activated and stopped and the refrigerant that flows in a small quantity into the inlet header immediately after the air conditioner is stopped are distributed appropriately by the distributing member before they move from an inlet portion of the inlet header to an inlet port. Thus, disturbance of currents and tributaries of the refrigerant flowing through the inlet port into the refrigerant tubes that communicate with the inlet of the refrigerant tank section can be reduced.

Accordingly, the state of the vortexes created in the refrigerant tank section changes, and the ratio of the tributaries delivered to the refrigerant passages varies. As a result, the quantity of the refrigerant that stays in the refrigerant tubes when the air conditioner is completely stopped is controlled, so that the incidence of pure tones produced when the air conditioner is reactivated is lowered to an extreme.

If a pure tone including substantial resonant elements is produced in an overheated gas, for example, the acoustic field is broken by a diaphragm or wire-net cylinder so that resonance is prevented to lower the pure tone level.

By forming the inlet-side refrigerant passages in a larger number than the outlet-side refrigerant passages, moreover, the distribution can be improved, and the local high-speed currents can be restrained so that the incidence of pure tones lowers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
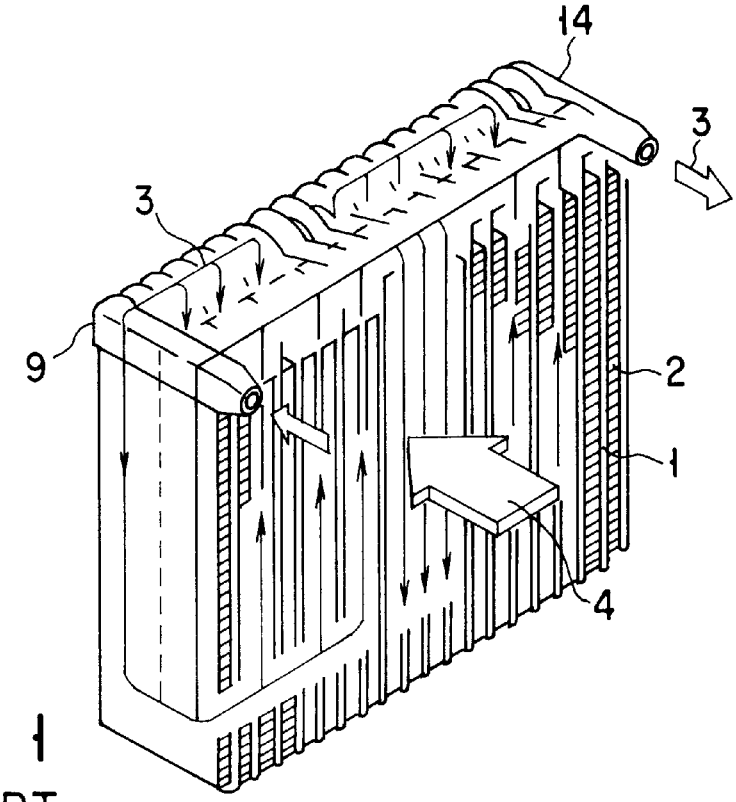
FIG. 1 PRIOR ART
FIG. 1 is a perspective view showing a prior art example of a laminated heat exchanger.

A first embodiment of the present invention will now be described in detail with reference to the accompanying drawings. In the following drawings, like reference numerals refer to like portions described with reference to FIGS. 1 to 7. Referring to FIGS. 10 to 14, there is shown a laminated heat exchanger according to the present embodiment, which is suitably used as an evaporator of an air conditioner, and comprises a radiating laminated structure 100, a refrigerant inlet header 20, and a refrigerant outlet header 22. The laminated structure 100 is formed by alternately arranging a plurality of refrigerant tubes 1 and corrugated fins 2 in layers. Each refrigerant tube 1 is formed of a tank section for storing a refrigerant and a passage section 8 through which the refrigerant is circulated.

Each refrigerant tube 1 is provided with a pair of molded plates 5*a* and 5*b*, which are bonded together so as to define the tank section 6 and the passage section 8. The passage section 8 is composed of shallow U-shaped tray portions formed individually in the molded plates 5*a* and 5*b*, while the tank section 6 is composed of shallow tray portions formed individually in the plates 5*a* and 5*b* and a port 10. An inner fin 8*a* is located in the passage section 8 of each refrigerant tube 1. The refrigerant inlet header 20 is connected to the tank section 6 on one side of the radiating laminated structure 100, and serves to feed the tank sections 6 with the refrigerant to be cooled. The refrigerant outlet header 22 is connected to the tank section 6 on the other side of the laminated structure 100, and serves to discharge the cooled refrigerant from the tank sections 6.

The heat exchanger according to the present embodiment is provided with a diaphragm 21 as a distributing member for regulating a flow of the refrigerant in the tank sections 6. The diaphragm 21, which is located in a refrigerant passage in the refrigerant inlet header 20 and/or the refrigerant outlet header 22, divides the refrigerant passage into a plurality of passages. The diaphragm 21 extends from one end of the refrigerant passage toward the other end through a junction between the passage and the adjacent tank section 6. The diaphragm 21 is designed so that the number of refrigerant passages in the headers 20 and 22 is larger than the number of refrigerant passages in the tank sections 6. The header-side flow area at the boundary between each of the headers 20 and 22 and its adjacent tank section 6 is larger than the flow area on the side of the tank section 6.

According to the laminated heat exchanger of the present invention constructed in this manner, a vortex created as the refrigerant flows into the refrigerant tank sections 6 through the refrigerant inlet header 20 and is distributed into the refrigerant tubes 1 can be reduced. Moreover, the resulting distributaries can be made uniform to restrain local high-speed currents. Thus, production of pure tones can be restrained effectively.

Figure 2:
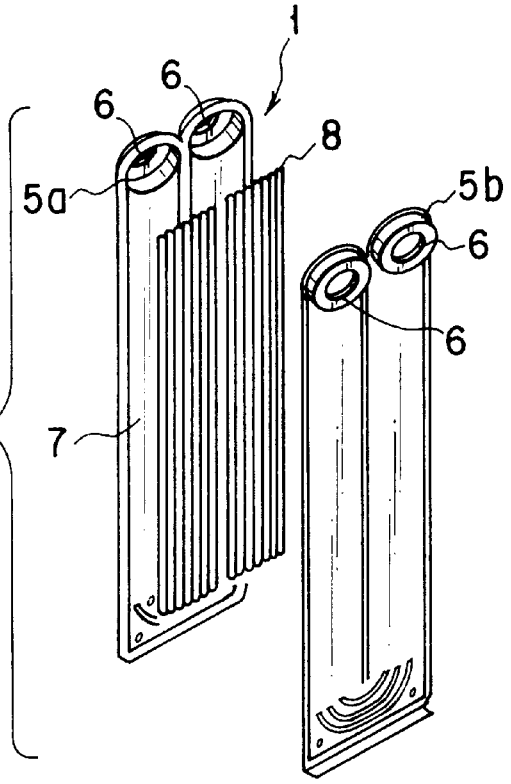
FIG. 2 PRIOR ART
FIG. 2 is an exploded perspective view of one refrigerant tube.
Figure 3:
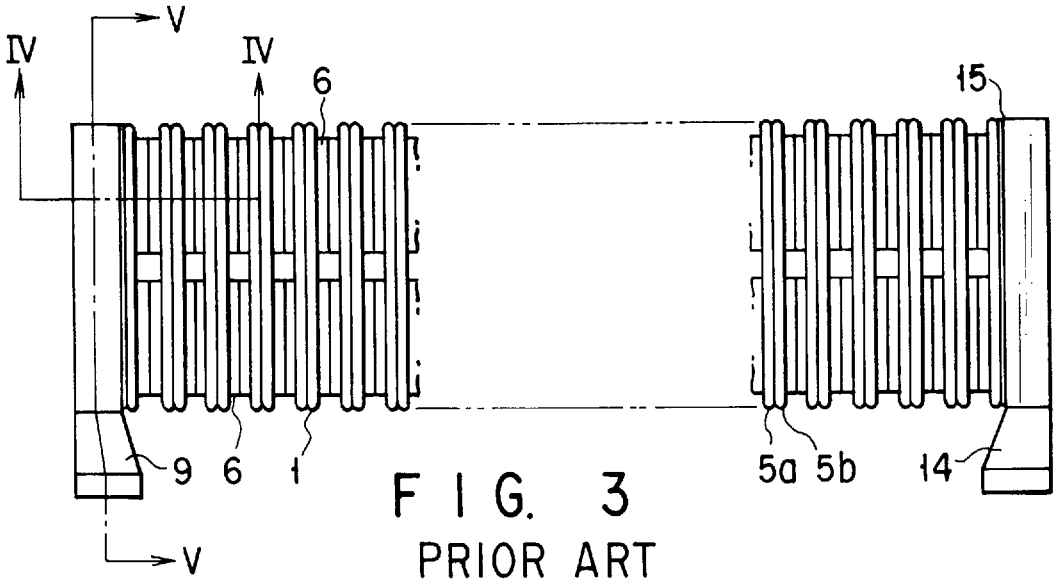
FIG. 3 PRIOR ART
FIG. 3 is a top plan view of the laminated heat exchanger.
Figure 4:
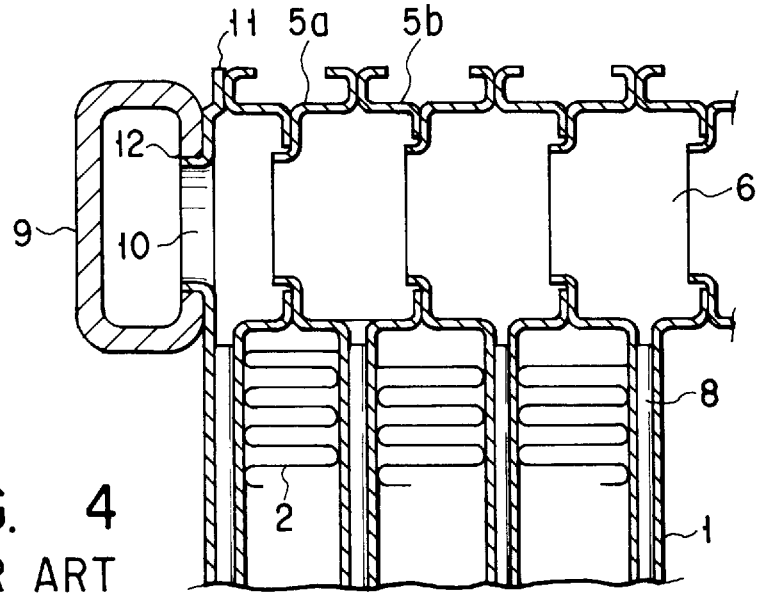
FIG. 4 PRIOR ART
FIG. 4 is a sectional view taken along line IV—IV of FIG. 3.
Figure 5:
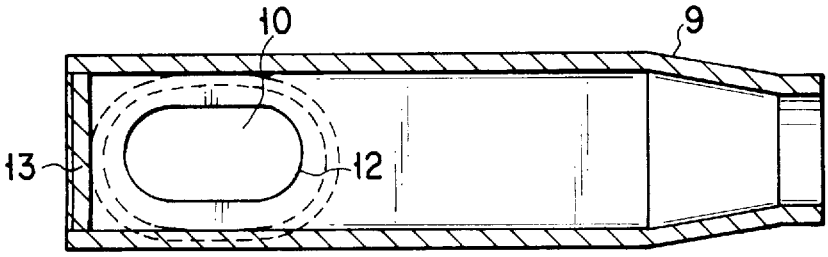
FIG. 5 PRIOR ART
FIG. 5 is a sectional view taken along line V—V of FIG. 3.
Figure 10:
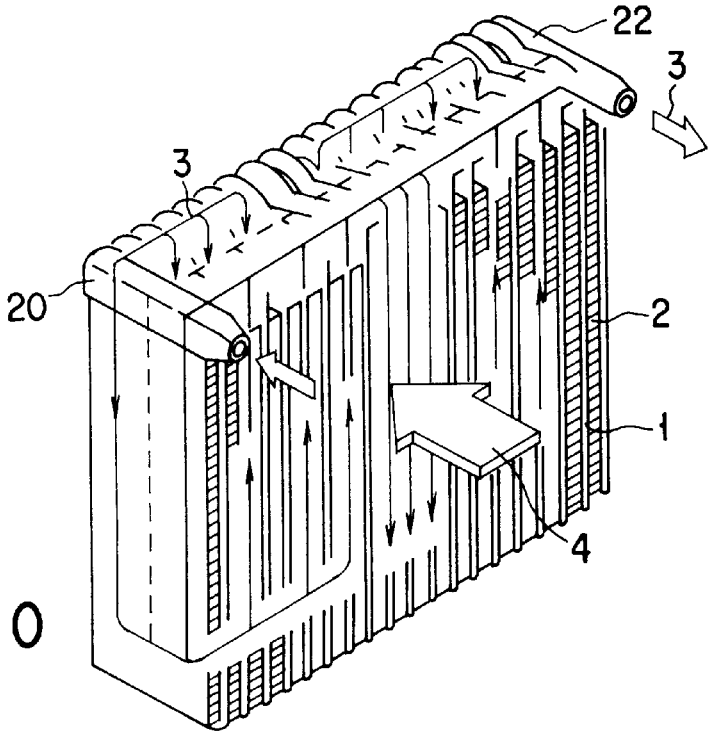
FIG. 10 is a general perspective view showing a first embodiment of a laminated heat exchanger according to the present invention.
Figure 11:
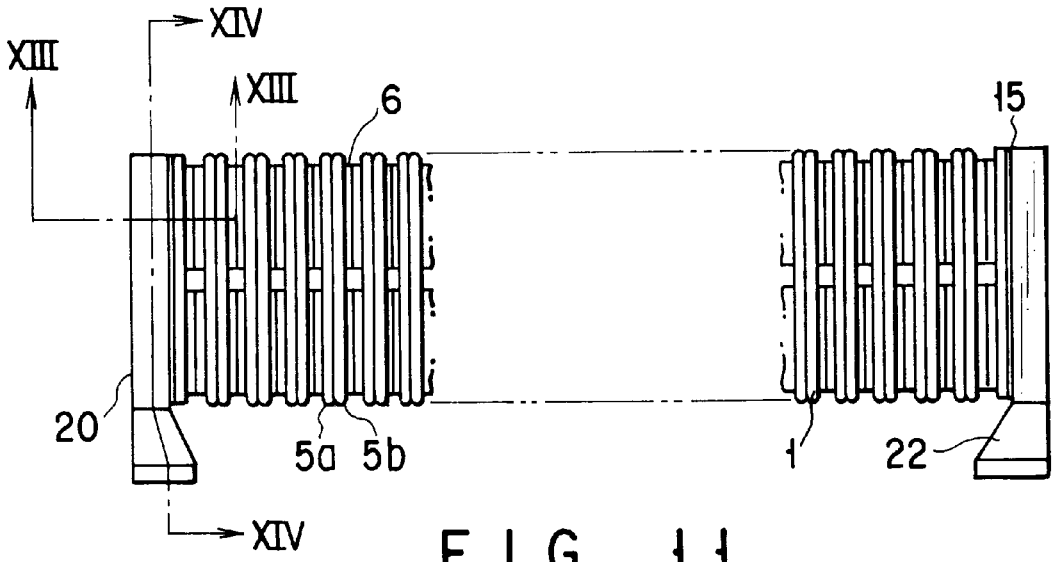
FIG. 11 is a plan view of the laminated heat exchanger.

The present embodiment will now be described further in detail. As shown in FIG. 10, the refrigerant tubes 1 and the corrugated fins 2 of the laminated heat exchanger 100 are arranged in layers, their respective top portions are connected to one another, and they all are integrally brazed together. The molded plates 5*a* and 5*b*, which, like the ones shown in FIG. 2, are paired and constitute each refrigerant tube 1, each have a shallow tray portion and deeper refrigerant tank sections 6 formed at one end thereof. The refrigerant inlet header 20 is provided on the upper portion of one side face of the laminated heat exchanger, while the refrigerant outlet header 22 is provided on the upper portion of the other side face of the heat exchanger.

Figure 12:
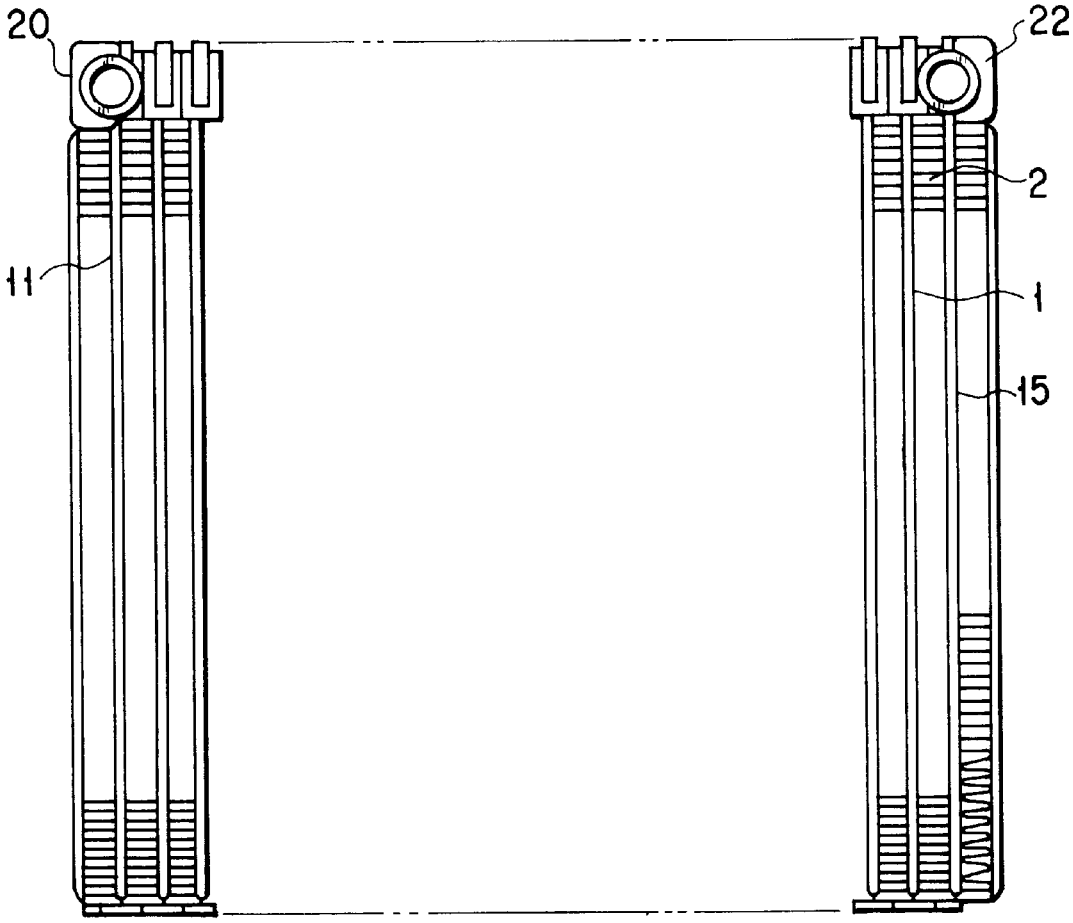
FIG. 12 is a top front view of the laminated heat exchanger.
Figure 13:
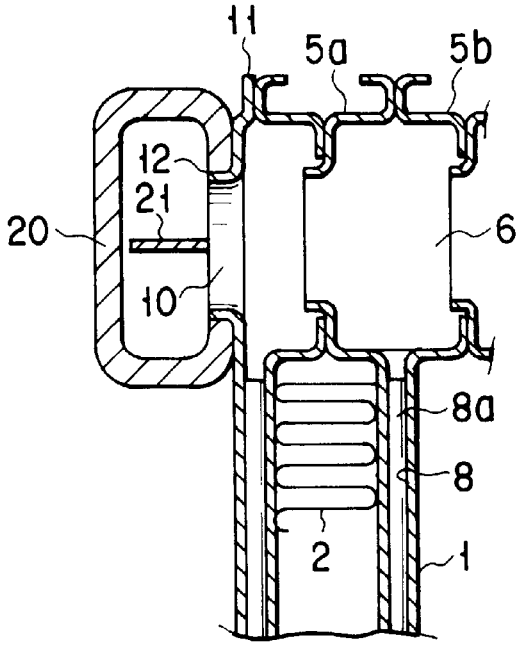
FIG. 13 is an enlarged sectional view of the laminated heat exchanger taken along line XIII—XIII of FIG. 11.
Figure 14:
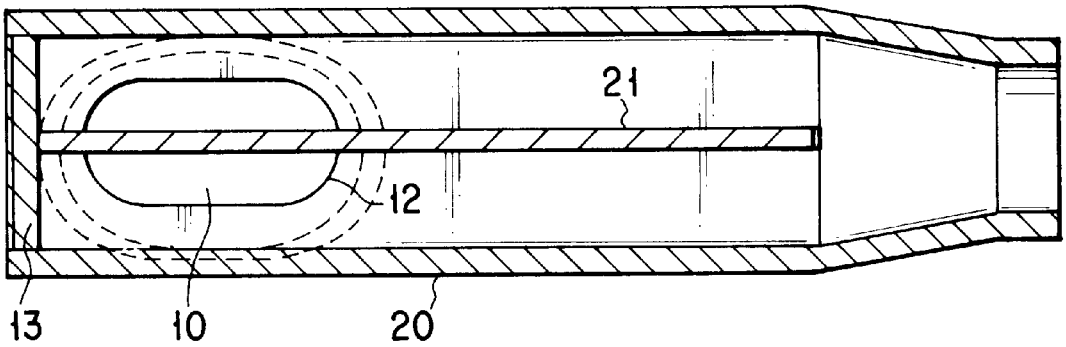
FIG. 14 is an enlarged sectional view of the laminated heat exchanger taken along line XIV—XIV of FIG. 11.

As shown in FIGS. 12 to 14, a plurality of refrigerant tubes 1 are arranged in layers on the refrigerant inlet header 20. An endplate 11 is formed having an inlet port 10 that opens into the refrigerant tank sections 6 at the upper portion of the one side face of the heat exchanger. A connecting hole 12, which is bored through a side face portion of the inlet header 20, is connected to the inlet port 10 in the endplate 11 by being fitted thereon. One end of the inlet header 20 serves as a refrigerant inlet portion that is connected to a refrigerant pipe of the air conditioner, and its junction has a cylindrical shape. The other end portion of the header 20 has a hollow configuration closed by a plug 13.

As shown in FIGS. 13 and 14, the diaphragm 21 is inserted in the refrigerant inlet header 20. The diaphragm 21 divides the refrigerant passage in the inlet header 20 in two, upper and lower. Thus, the diaphragm 21 is inserted along the refrigerant passage, extending from the region near the inlet portion of the inlet header 20 to the plug 13 that closes the other end portion of the header 20 so as to divide the inlet portion of the inlet port 10 in the endplate 11.

On the other hand, a plurality of refrigerant tubes 1 are arranged in layers on the refrigerant inlet header 22. An endplate 15 is formed having a refrigerant outlet port (not shown) that opens into the refrigerant tank sections 6 at the upper portion of the other side face of the heat exchanger. A connecting hole (not shown), which is bored through a side face portion of the outlet header 22, is connected to the outlet port by being fitted thereon. An outlet portion of the outlet header 22 has a cylindrical shape adapted for connection with the refrigerant passage, while the other end portion has a hollow configuration closed by a plug.

Normally, in the case where the heat exchanger is used as an evaporator, the flow path is designed so that the flow area increases from the refrigerant inlet side toward the outlet side in accordance the refrigerant volume that changes as the refrigerant evaporates. According to the laminated heat exchanger of the present embodiment, in contrast with this, the inlet-side flow area is made larger than the outlet-side flow area in order to obtain the distribution to prevent the production of pure tones or to restrain local high-speed currents.

Figure 15:
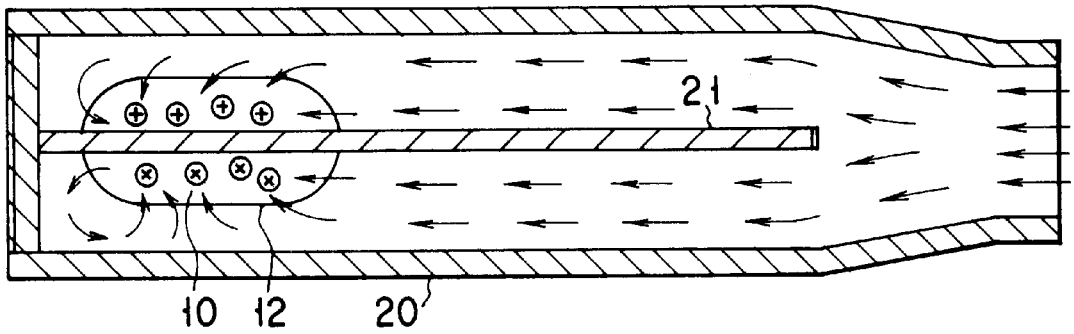
FIG. 15 is a view showing regulated refrigerant flows in a refrigerant inlet header.

The following is a description of the operation of the heat exchanger constructed in the manner described above. The refrigerant fed from the refrigerant inlet header 20 under pressure is vertically divided by the diaphragm 21 as it flows through the refrigerant passage in the inlet header 20, whereby the refrigerant flows are regulated, as shown in FIG. 15. Then, the refrigerant gets into the refrigerant tank sections 6 through the connecting hole 12 of the inlet header 20 and the inlet port 10 in the endplate 11, forms a refrigerant flow 3 shown in FIG. 10, exchanges heat with air, and is discharged through the refrigerant outlet header 22.

In the case where the laminated heat exchanger of the present embodiment is applied to the evaporator of the air conditioner, the refrigerant that flows into the refrigerant inlet header 20 immediately after the air conditioner is activated during its intermittent operation in which it is repeatedly activated and stopped is large in quantity. The refrigerant thus flowing in a large quantity into the inlet header 20 and the refrigerant that flows in a small quantity into the inlet header immediately after the air conditioner is stopped are vertically divided and distributed appropriately by the diaphragm 21 before they move from the inlet portion of the inlet header 20 to the inlet port 10. Accordingly, the refrigerant that changes its course at 90° as it flows from the inlet port 10 into the refrigerant tubes 1 through the refrigerant tank sections 6 is subject to no substantial turbulence or vortexes, and the distribution is improved. In consequence, pure tones can be prevented from being produced by turbulent refrigerant flows or local high-speed currents. Thus, the essential part of the refrigerant flow is divided in two, so that only small vortexes are created at the abutting portion of the refrigerant inlet header 20, and the main current of the refrigerant flowing into the refrigerant tank sections 6 is situated substantially in the center of the inlet port 10.

Figure 16:
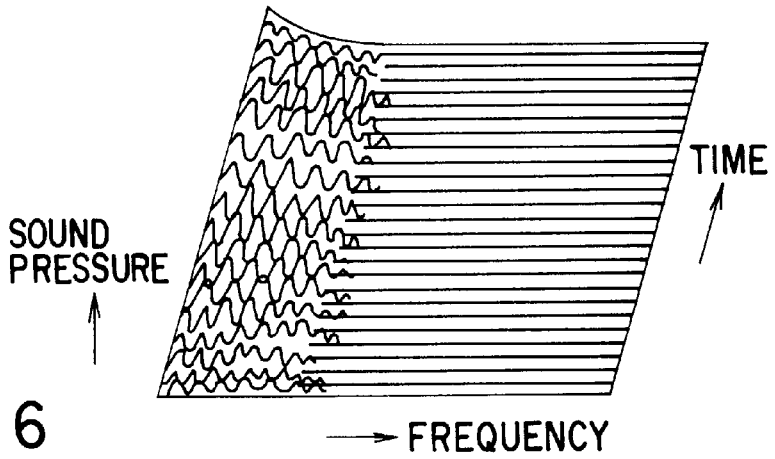
FIG. 16 is a view showing the way the production of pure tones is prevented by means of refrigerant flows regulated by a diaphragm.
Figure 17:
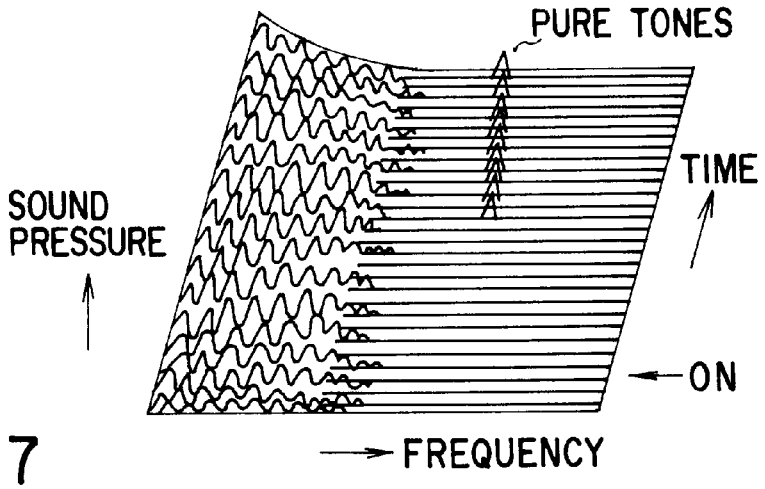
FIG. 17 is a view showing the way pure tones are produced.

Accordingly, the state of the vortexes created in the refrigerant tank sections 6 changes, and the ratio of the tributaries delivered to the refrigerant passages varies. As a result, the quantity of the refrigerant that stays in the refrigerant tubes 1 when the air conditioner is completely stopped is controlled, so that the incidence of pure tones produced when the air conditioner is reactivated is lowered to a minimum. FIG. 16 is a view showing the way the production of pure tones is prevented by means of the refrigerant flows regulated by the diaphragm 21, and FIG. 17 is a view showing the way pure tones are produced.

Thus, according to the first embodiment, the diaphragm 21 is inserted in the refrigerant inlet header 20 so as to divide the refrigerant passage in the header 20 vertically. In the case where the laminated heat exchanger of the present embodiment is applied to the evaporator of the air conditioner, for example, the refrigerant flows in a large quantity into the inlet header 20 immediately after the air conditioner is activated or in a small quantity immediately after the air conditioner is stopped. Even in this case, the refrigerant is distributed appropriately by the diaphragm 21. Thus, the refrigerant is subject to no substantial turbulence or vortexes, and the distribution is improved. In consequence, pure tones can be prevented from being produced by turbulent refrigerant flows or local high-speed currents. If a pure tone including substantial resonant elements is produced in an overheated gas, moreover, the diaphragm 21 breaks the acoustic field so that resonance is prevented to lower the pure tone level.

Although the diaphragm 21 is inserted in the refrigerant inlet header 20 according to the first embodiment, it may alternatively be inserted in the refrigerant outlet header 22 or in each of the headers 20 and 22 with the same result.

Figure 6:
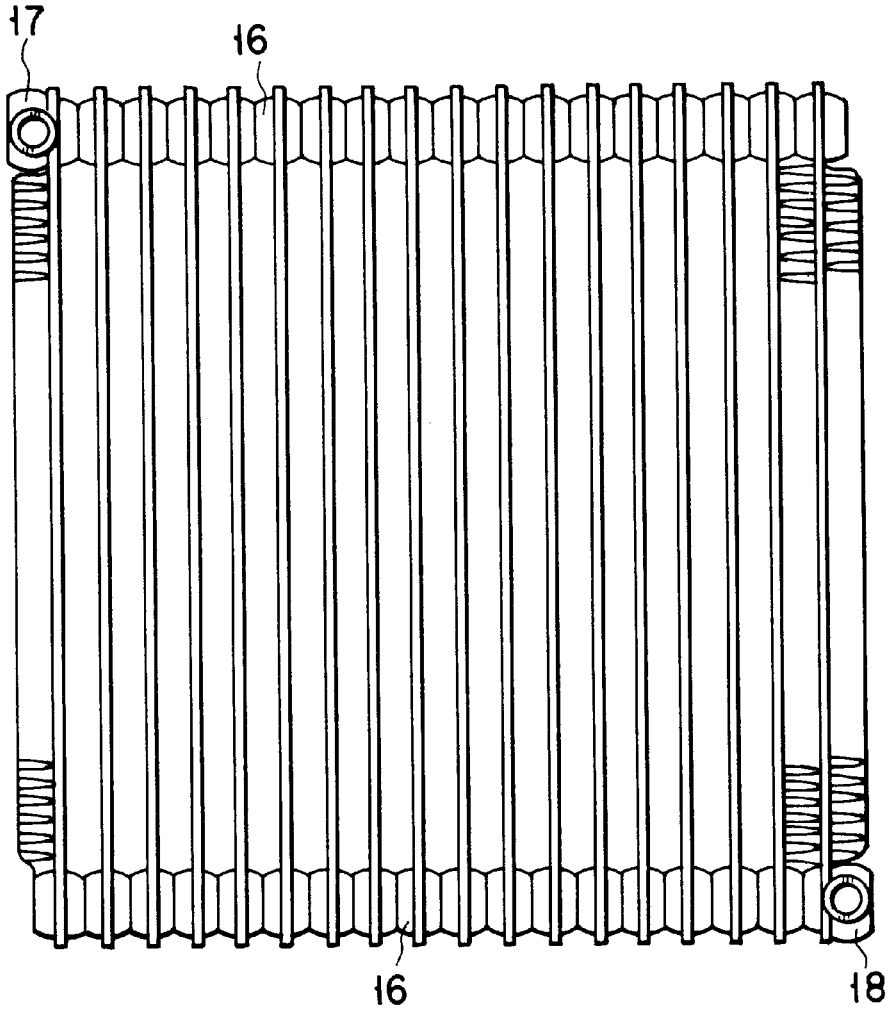
FIG. 6 PRIOR ART
FIG. 6 is a side view showing another prior art example of the laminated heat exchanger.
Figure 7:
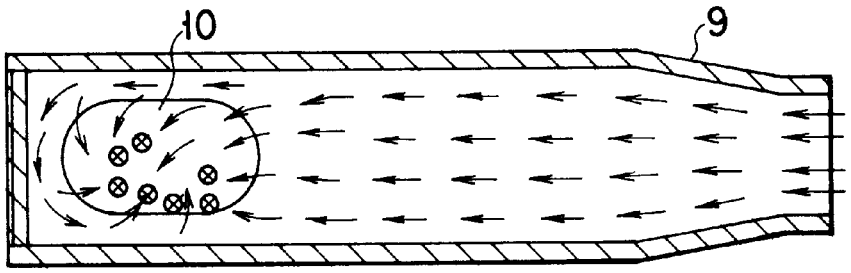
FIG. 7 PRIOR ART
FIG. 7 is a view showing a large vortex produced as a refrigerant flows in a refrigerant inlet header.
Figure 8:
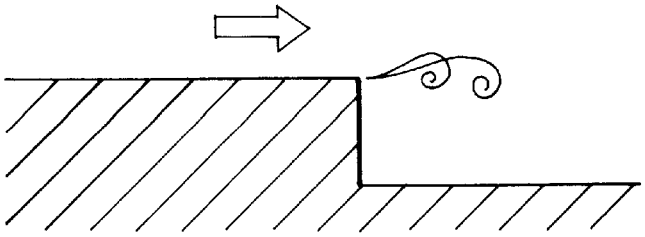
FIG. 8 PRIOR ART
FIGS. 8 and 9 are views for illustrating the principle of production of a pure tone.
Figure 9:
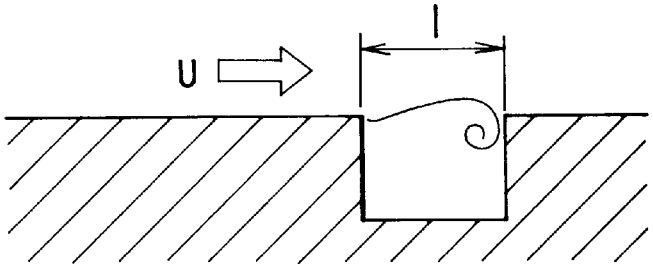
FIG. 9 PRIOR ART

The same effect of the first embodiment may be also obtained by inserting the diaphragm 21 in each of the refrigerant inlet and outlet headers 17 and 18 of the laminated heat exchanger that has the refrigerant tank sections on the opposite sides of the laminated structure 100 as a core section, as shown in FIG. 6.

The refrigerant on the outlet side may be in the form of either a vapor-liquid (two-phase) flow or an overheated gas flow. In the case where pure tones are produced in the vicinity of the outlet-side tank section 6 and the refrigerant outlet header 18, vortexes can be reduced to restrain the production of pure tones by a flow-regulating effect.

Figure 18:
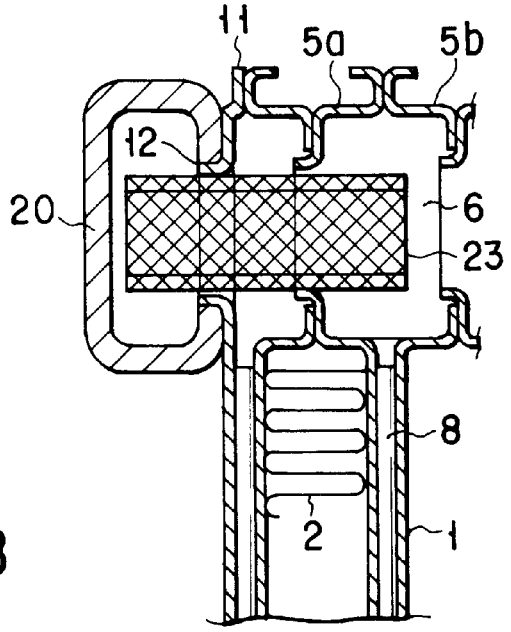
FIG. 18 is an enlarged sectional view of a refrigerant inlet: header showing a second embodiment of the laminated heat exchanger according to the invention.

Referring now to FIG. 18, a second embodiment of the present invention will be described. A distributing member of the present embodiment includes a wire-net cylinder 23. One end portion of the cylinder 23 is inserted into a junction between the refrigerant passage and one of the tank sections 6, while the other end portion projects into the tank section 6.

The second embodiment will now be described further in detail. A net, preferably the wire-net cylinder 23, for regulating refrigerant flows is inserted in the refrigerant inlet header 20. The cylinder 23, which is formed by rolling up a wire sheet, is fitted in a hole in the refrigerant inlet header 20, which communicates with the refrigerant tank section 6, so as to project into the tank section 6.

Normally, in the case where the laminated heat exchanger of the present embodiment, like the one according to the first embodiment, is used as an evaporator, the flow path is designed so that the flow area increases from the refrigerant inlet side toward the outlet side in accordance the refrigerant volume that changes as the refrigerant evaporates. Also in this case, however, the inlet-side flow area is made larger than the outlet-side flow area in order to obtain the distribution to prevent the production of pure tones or to restrain local high-speed currents.

In this arrangement, the refrigerant fed from the refrigerant inlet header 20 under pressure is distributed appropriately by the wire-net cylinder 23 as it flows through the refrigerant passage in the inlet header 20. Then, the refrigerant gets into the refrigerant tank sections 6 through the connecting hole 12 of the inlet header 20 and the inlet port 10 in the endplate 11, forms the refrigerant flow 3 shown in FIG. 10, exchanges heat with air, and is discharged through the refrigerant outlet header 22.

Thus, in the case where the laminated heat exchanger of the present embodiment is applied to the evaporator of the air conditioner, the refrigerant that flows in a large quantity into the refrigerant inlet header 20 immediately after the air conditioner is activated during its intermittent operation in which it is repeatedly activated and stopped and the refrigerant that flows in a small quantity into the inlet header immediately after the air conditioner is stopped are distributed appropriately by the wire-net cylinder 23. Accordingly, the refrigerant that changes its course at 90° as it flows from the inlet port 10 into the refrigerant tubes 1 through the refrigerant tank sections 6 is subject to no substantial turbulence or vortexes, and the distribution is improved. In consequence, pure tones can be prevented from being produced by turbulent refrigerant flows or local high-speed currents.

Thus, according to the second embodiment, as in the first embodiment, the refrigerant is subject to no substantial turbulence or vortexes, and the distribution is improved, so that pure tones can be prevented from being produced by turbulent refrigerant flows or local high-speed currents. If a pure tone including substantial resonant elements is produced in an overheated gas, moreover, the wire-net cylinder 23 breaks the acoustic field so that resonance is prevented to lower the pure tone level.

The present invention is not limited to the first and second embodiments described above, and may be modified in the following manner. For example, the inlet-side refrigerant passages may be formed in a larger number than the outlet-side refrigerant passages. By doing this, improved refrigerant distribution can be obtained, and the local high-speed currents can be restrained. Thus, the incidence of pure tones can be lowered.

Depending on the contents of produced pure tones, the diaphragm 21 according to the first embodiment or the wire--net cylinder 23 according to the second embodiment may be inserted in the inlet header 20 and/or the outlet header 22, or the inlet-side refrigerant passages may be increased in number.

According to the present invention, as described in detail herein, there may be provided a laminated heat exchanger in which vortexes that are created as the refrigerant flows into the refrigerant tank sections through the refrigerant inlet header and is distributed into the refrigerant tubes can be reduced, and the resulting distribution can be made uniform to restrain local high-speed currents, whereby production of pure tones can be restrained.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A laminated heat exchanger comprising:

a radiating laminated structure formed by alternately arranging a plurality of refrigerant tubes and fins in layers, each said refrigerant tube having a tank section for storing a refrigerant and passage section in which the refrigerant stored in the tank section is circulated;

an inlet pipe having a refrigerant passage therein, connected to the tank section on one side of the radiating laminated structure, and serving to feed the refrigerant to be cooled from said refrigerant passage to the tank section, the outlet pipe being external to the tank section of the laminated heat exchanger;

an outlet pipe having a refrigerant passage therein, connected to the tank section on the other side of the radiating laminated structure, and serving to discharge the cooled refrigerant from the tank section to the refrigerant passage, the outlet pipe being external to the tank section of the laminated heat exchanger; and a regulating member arranged in at least one of the refrigerant passage of the inlet pipe and the outlet pipe, for regulating a flow of the refrigerant in the refrigerant passage of the inlet pipe and the outlet pipe.

2. A laminated heat exchanger according to claim 1, wherein said regulating member comprises a diaphragm dividing the refrigerant passage into a plurality of passages, said diaphragm extends from one end of the refrigerant passage toward the other end through a junction between the passage and the adjacent tank section.

3. A laminated heat exchanger according to claim 1, wherein said regulating member comprises a cylindrical net having one end portion inserted in a junction between the refrigerant passage and the tank section and the other end portion projecting into the tank section.

4. A laminated heat exchanger according to claim 1, wherein said radiating laminated structure has inlet-side passages and outlet-side passages, the number of inlet-side passages is larger than the number of outlet-side passages.

5. A laminated heat exchanger according to claim 1, wherein the header-side flow area at the boundary between each said header and said tank section is larger than the tank-side flow area.

6. A laminated heat exchanger according to claim 1, wherein each said refrigerant tube includes a pair of molded plates joined together so as to form the tank section and the passage section, the passage being composed of shallow U-shaped tray portions formed individually in the molded plates, the tank section being composed of shallow tray portions formed individually in the plates and an aperture.

7. A laminated heat exchanger according to claim 1, wherein the passage section of each said refrigerant tube has fins therein.

* * * * *